United States Patent [19]

Henmi et al.

[11] 3,983,916

[45] Oct. 5, 1976

[54] PROCESS FOR PRODUCING SEMI-HARD Co-Nb-Fl MAGNETIC MATERIALS

[75] Inventors: Zenzo Henmi, Kawasaki; Masanori Okada, Yokohama; Makoto Kassai, Yokohama; Takehiko Sato, Yokohama; Toshio Kobayashi, Yokohama; Etsuo Hanada, Yokohama, all of Japan

[73] Assignee: Fujitsu Ltd., Japan

[22] Filed: Nov. 4, 1974

[21] Appl. No.: 520,739

[30] Foreign Application Priority Data

Nov. 12, 1973 Japan ..... 48-126907

[52] U.S. Cl. ..... 148/120; 75/170; 148/31.55; 148/121

[51] Int. Cl.[2] ..... H01F 1/00

[58] Field of Search ..... 148/120, 121, 31.55, 148/122; 75/170

[56] References Cited

UNITED STATES PATENTS

| | | | |
|---|---|---|---|
| 3,065,118 | 11/1962 | Wawrousek et al. | 148/122 |
| 3,189,493 | 6/1965 | Chen | 148/120 |
| 3,390,443 | 7/1968 | Gould et al. | 148/31.55 |
| 3,698,055 | 10/1972 | Holtz et al. | 75/170 |
| 3,743,550 | 7/1973 | Masumoto et al. | 148/31.55 |
| 3,801,312 | 4/1974 | Steinitz | 75/170 |

*Primary Examiner*—Walter R. Satterfield
*Attorney, Agent, or Firm*—Staas & Halsey

[57] ABSTRACT

A semi-hard magnetic material characterized by a high coercive force (Hc), i.e. 20–50 Oe, can be produced by the disclosed process.

In accordance with the process, an alloy consisting of 73 to 93% Co and 3 to 7% Nb, and the balance being iron is worked into a suitable form, solution treated, cold worked at a reduction of area not lower than 75% and aged. Said alloy contains niobium in a greater amount than the known alloy for the same application in order to enhance the coercive force. With the increase in the content of niobium, however, the cold workability of the alloy deteriorates. In order to overcome this disadvantage, the Inventors provide particular conditions for the solution treatment. The solution treatment consists of heating the alloy to a temperature not lower than 1000°C and cooling it to room temperature. During the cooling, quenching of the alloy should be started at 800°C or higher and continued to a temperature of 500°C or less.

14 Claims, 12 Drawing Figures

PROCESS FOR PRODUCING SEMI-HARD Co-Nb-Fl MAGNETIC MATERIALS

BACKGROUND OF THE INVENTION

This invention relates to a process for producing semi-hard magnetic materials suited for self holding type reed switches and, more particularly, a process for producing cobalt-niobium-iron based semi-hard magnetic materials having a desired form of hysterisis loop and remanent property required for small-sized reed switches. The semi-hard magnetic material generally means a magnetic material having intermediate properties between the soft magnetic material and permanent magnetic material, i.e. hard magnetic material. The semi-hard magnetic material utilizes the remanence property like the permanent magnet and is required to have a property permitting ready rotation of domains, similar to the soft magnetic material. In general, semi-hard magnetic materials utilized in such applications should possess the following properties.

1. Both saturated magnetic flux density (Bs) and residual magnetic flux density (Br) are high.

2. The square hysteresis loop exhibits a high squareness ratio (Br/Bs) and a high "fullness factor" in the second quadrant. The term fullness factor used herein is represented by the formula:

$$\sqrt{(BH)_{max}/Br\ Hc}$$

wherein $(BH)_{max}$ is the maximum magnetic energy product and $Hc$ is coercive force.

3. The coercive force (Hc) is within the range of 10 and 50 Oe.

4. The plastic workability characteristic is excellent, since these materials are capable of being easily worked into any desired shape such as, for example, a fine wire rod, a sheet or a tape.

Some of the inventors of the present invention previously provided a process for producing such semi-hard magnetic materials, in which process an alloy consisting essentially by weight of 73 to 93% of cobalt, 1 to 5% of niobium and the balance being iron is worked into a semi-finished product, subjected to a final process annealing at a temperature not lower than 900°C, and subsequently to a final cold-working at a reduction of area not lower than 75%. Said some inventors have also previously provided a process for producing the semi-hard magnetic materials, wherein after the final cold-working mentioned above the alloy is subjected to ageing at a temperature not higher than 950°C.

Due to the recent trend toward miniaturization of reed switches it is required that the semi-hard magnetic material used in such switches possess a coercive force of not lower than 20 Oe. In order to produce semi-hard magnetic material having the desired coercive force by means of the known process, the content of niobium in the alloy should be maintained in the range of 3 to 5%. In other words, the alloy containing 1 to 3% of niobium cannot be used for miniaturized reed switches. The increase in the content of niobium brings about the formation of an intermetallic compound of niobium. It is, therefore, possible to produce a semi-hard magnetic material having moderate coercive force, i.e. not lower than 20 Oe, if the precipitated amount of the intermetallic compounds is controlled by any suitable method.

The increase in the content of niobium is, however, accompanied by a promoted hardening of the alloy resulting from both a solid solution hardening and a precipitation hardening. The alloy is, therefore, quite hard during the process of cold working so that the cold-working becomes extremely difficult. Experiments have shown that the alloy material containing more than 4% of niobium obviously tends to rupture while being drawn into a wire-rod, with the result that the desired semi-hard magnetic material can not be produced on a mass production scale.

Therefore, only if the final process annealing is followed by extremely slow cooling or if the final cold drawing is divided into a number of drawing steps each causing an extremely small reduction of area, for example approximately 2%, can the alloy be worked into the finished product, thereby ensuring the total reduction of area to the desired value. Such a slow cooling or repeated cold working at a low reduction of area should be avoided from a practical point of view because both of the processes for producing the semi-hard magnetic materials are too complicated and expensive.

SUMMARY OF THE INVENTION

It is the object of the present invention to provide a process for producing semi-hard magnetic materials, containing niobium in a larger amount than in previously known semi-hard magnetic materials by means of simple heat treatment and cold working; which materials are characterized by a coercive force of 20 to 50 Oe and, in addition, possess the properties generally required for a semi-hard magnetic material.

According to the present invention, a process is provided for producing a semi-hard magnetic material comprising the steps of: working an ingot of alloy consisting essentially, by weight, of 73 to 93% of cobalt, 3 to 7% of niobium, and the balance being iron, into an article having a suitable form; heating the article to a solution temperature not lower than 1000°C and then cooling it to room temperature, in which cooling the article is quenched starting at a temperature not lower than 800°C and ending at a temperature of 500°C at the highest, thereby subjecting the article to solution treatment; then, subjecting the article so treated to cold working at a reduction of area not less than 75%, and; finally, ageing the cold worked article at a temperature from 500° to 900°C.

DETAILED DESCRIPTION OF THE INVENTION

Figure 1:
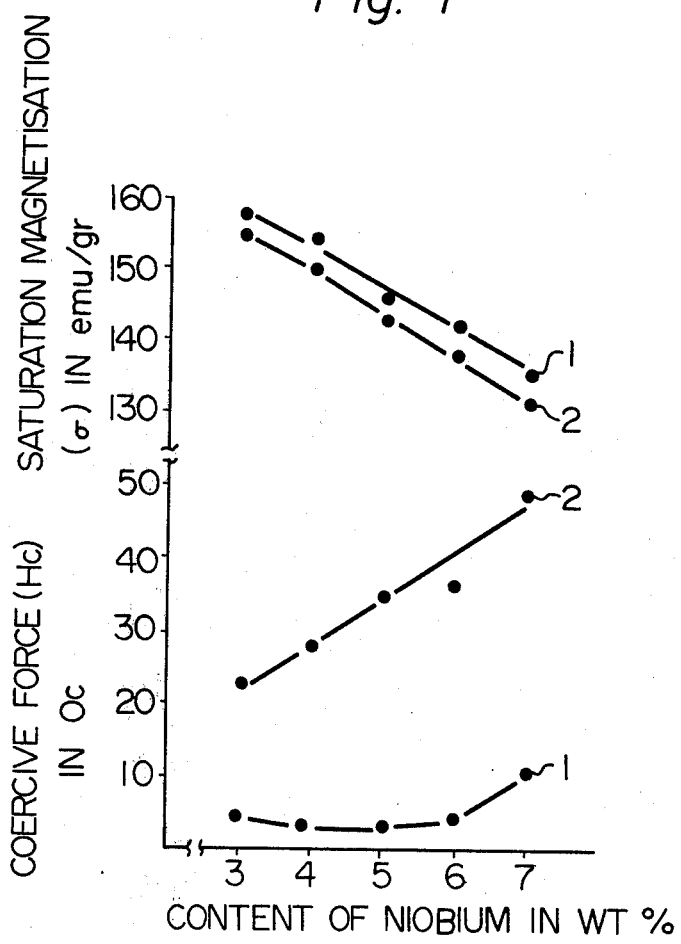
FIG. 1 is a graph illustrating the relationship of magnetic properties to the content of niobium in various samples.

The alloy for the semi-hard magnetic material of the present invention comprises 73 to 93% by weight of cobalt. If the content of cobalt is below 73%, the alloy material is too hard to practice the desired cold working, with the result that both the squareness ratio and the fullness factor deteriorate. The inventors have found that an alloy material comprising less than 73% of cobalt is accompanied by a crystal transformation during the cold working thereof, in a manner such that a part of the face centered cubic lattices is transformed to body centered cubic lattices. The insufficient plastic workability is attributed to this crystal transformation. If the content of cobalt is increased to more than 93%, the plastic workability also becomes inferior to an alloy composed of the ingredients taken in a proportion according to the present invention, due to a crystal transformation during the cold working in a manner such that a part of the face centered cubic lattices is transformed to closed packing hexagonal lattices.

The niobium contained in the alloy according to the present invention is in an amount of from 3 to 7% and this exercises a great effect on the improvement of properties desired for the semi-hard magnetic material. If the content of niobium is below 3%, the coercive force is too low. On the other hand, if the content of niobium is in excess of 7%, the plastic workability is deteriorated and the saturated magnetic flux density is decreased, although the coercive force is advantageously increased. The content of niobium should, therefore, be limited to within the range of from 3 to 7%, in order to satisfy the plastic workability and the saturated magnetic flux density.

Such being the contents of cobalt and niobium, the iron constituting the balance of the alloy is contained therein in the range of between a minor but effective percent and 24% by weight. The lower limit percentage of iron may preferably be 5% by weight.

The contents of cobalt and iron should preferably be selected from the intermediate range of the stated percentage values, because an alloy containing cobalt and iron in amounts close to the critical values has cold workability inferior to the alloy composed of the intermediate composition. The alloy should thus preferably comprise 78 to 90% of cobalt, 3 to 7% of niobium and 6 to 18% of iron. The alloy should more preferably comprise 80 to 87% of cobalt, 4 to 5% of niobium and 9 to 15% of iron to provide the alloy with far improved cold workability.

The semi-hard magnetic material according to our invention may comprise a small amount of impurities.

The above defined alloy material can be obtained by melting conventional raw materials for the alloy, such as an electrolytic cobalt, an electrolytic iron and a ferroniobium metal, in an induction furnace, preferably a vacuum induction furnace, and then a melt of the alloy is cast into a mold to form an ingot.

The process for producing a semi-hard magnetic material can roughly be divided into two aspects. In the first aspect, the ingot is roughly shaped into an article of any desired form. The ingot is at first annealed at a temperature preferably from 1000° to 1200°C and then worked into, for example, a wire-rod by using a hot swaging machine, cold swaging machine or a drawing machine. The dimensions of the article at the end of this working should be such that the area thereof is four times greater than the area of the finished product to be worked in the second aspect described below. The ingot is usually worked in multi stages and a process annealing at a temperature between 1000° and 1200°C should preferably be carried out between the stages to restore the plastic workability. As is stated above, the first aspect of the process aims to roughly shape the ingot. Any conventional methods for shaping ingots can be employed to produce the article to be subjected to the second aspect, in which the article is finished and provided with the desired magnetic properties.

In the second aspect the alloy article, shaped as mentioned above is treated in accordance with the following three steps of the present invention. The article is at first heated at a temperature not lower than 1000°C and below the solidus (hereinafter referred to as a solution temperature) to subject it to a solution treatment. If the solution temperature is below 1000°C it is not possible to sufficiently soften the article, which has been hardened due to the preceding workings, and thus, the plastic workability of the article can not be restored. If the solution temperature is too low, magnetic properties, in addition to the plastic workability, deteriorate. The article heated at the solution temperature is then cooled to ambient temperature in a manner such that the article is quenched starting from a temperature not lower than 800°C and ending at a temperature of 500°C at the highest. The quenching herein used is thus the immersion into a liquid or molten medium having a temperature 500°C at the highest, for example, water, brine, a liquid inert gas and even a salt bath. When the temperature of the medium for quenching is substantially higher than room temperature, for example 300° to 500°C, the alloy can be maintained in the medium for a certain period of time and then cooled to the room temperature. This cooling with interruption is advantageous when it is not desired that a great thermal stress be applied to the article shaped by the preceding aspect.

The article can be cooled at any cooling rate at temperature ranges where it is not quenched. The alloy can also be advantageously quenched in these ranges. One possible method of solution treatment is as follows: heating at 1100°C and, then, furnace-cooling to 900°C; immersion into a molten salt bath at 400°C; cooling in still air.

As is stated above the quenching should start at a temperature not lower than 800°C and terminate at a temperature not higher than 500°C. If the quenching starts at a temperature below 800°C, the article cannot be sufficiently softened and, thus, cannot be easily worked to a desired reduction of area. If the quenching terminates at a temperature exceeding 500°C, the article hardens during cooling from the terminating temperature to ambient temperature.

The solution-treated article should be subjected to cold working at a reduction of area not less than 75%. If the reduction of area is below 75%, the coercive force (Hc), the magnetic flux density ($B_{100}$) and the fullness factor ($Br/B_{100}$) are all too low. The article is formed into its final size and shape by the cold working of this step.

The cold worked article is finally aged at a temperature within the range between 500° and 900°C. If the ageing temperature does not fall within this range, the coercive force (Hc) of the material is not satisfactory. It is to be noted that the ageing time should be adjusted to a suitable value depending upon the ageing temperature. For example, the ageing times should preferably be more than 100 hours and approximately 10 seconds at ageing temperatures of 500° and 900°C, respectively.

The present invention will be illustrated in detail by way of the following examples.

EXAMPLE 1

Mixtures consisting of electrolitic cobalt, electrolitic iron and ferroniobium were prepared so that each mixture consisted essentially by weight of cobalt, iron and niobium in the proportions as shown in Table I.

TABLE I

| Sample No. | Composition of Alloy Co (wt %) | Fe (wt %) | Nb (wt %) |
|---|---|---|---|
| 1 | 85 | 12 | 3 |
| 2 | 84 | 12 | 4 |
| 3 | 83 | 12 | 5 |
| 4 | 82 | 12 | 6 |
| 5 | 81 | 12 | 7 |
| 6 | 90 | 6 | 4 |
| 7 | 87 | 9 | 4 |
| 8 | 81 | 15 | 4 |
| 9 | 78 | 18 | 4 |
| 10 | 88 | 12 | 0 |
| 11 | 87 | 12 | 1 |
| 12 | 86 | 12 | 2 |

Each mixture was melted in an alumina crucible using a vacuum induction furnace. The melt was then cast into a mold, to obtain ingots 40 mm in diameter and weighing 3.2 kg. The ingots were homogenized at a temperature of 1200°C for 5 hours. The ingots so treated were hot worked into round bars of 20 mm diameter at a temperature of 1200°C by means of a hot swaging machine. The bars were subjected to cold workings in multi-stages to form wire-rods having a diameter of 2 mm by means of a cold-swaging machine and cold drawing machine. An annealing process at a temperature of 1100°C was carried out between the cold working stages.

The wire-rods having a diameter of 2 mm were heated at 1100°C for 30 minutes to pass the precipitated components into a solid solution and, immediately after this heating the wire-rods were quenched in water. The wire-rods were then cold-drawn by repeating single-draft drawing at a reduction of area of approximately 10% to decrease their diameters to the final value, i.e. 0.6 mm. The total reduction of area by cold working in this step therefore amounted to 91%. The wire-rods, so formed, were subjected to a straightening process in order to remove the curve thereof and to ageing in a vacuum at the temperatures shown in Tables II and III for 1 hour. Dependence of the saturation magnetization ($\sigma$) in emu/gr and the coercive force (Hc) in Oe of the wire-rods, so manufactured, upon the ageing temperature are shown in Tables II and III, respectively.

Table II

| Sample No. | Saturation Magnetization ($\sigma$) in emu/gr — Ageing Temperature in °C: A.D. | 400 | 500 | 600 | 700 | 800 | 900 | 1000 |
|---|---|---|---|---|---|---|---|---|
| 1 | 157 | 157 | 157 | 157 | 155 | 154 | 155 | 156 |
| 2 | 152 | 152 | 152 | 152 | 150 | 148 | 150 | 151 |
| 3 | 146 | 146 | 146 | 145 | 145 | 142 | 145 | 145 |
| 4 | 142 | 142 | 142 | 140 | 138 | 138 | 140 | 141 |
| 5 | 135 | 135 | 135 | 134 | 132 | 131 | 133 | 134 |
| 6 | 146 | 146 | 146 | 146 | 144 | 142 | 143 | 145 |
| 7 | 149 | 149 | 149 | 148 | 147 | 144 | 145 | 148 |
| 8 | 154 | 154 | 154 | 154 | 153 | 150 | 152 | 153 |
| 9 | 160 | 161 | 161 | 159 | 159 | 155 | 155 | 156 |

Note:
A.D. means the wire-rod was not subjected to ageing.

Table III

| Sample No. | Coercive Force (Hc) in Oe — Ageing Temperature in °C: A.D. | 400 | 500 | 600 | 700 | 800 | 900 | 1000 |
|---|---|---|---|---|---|---|---|---|
| 1 | 7 | 7 | 9 | 16 | 22 | 19 | 12 | 1 |
| 2 | 6 | 6 | 8 | 15 | 28 | 23 | 13 | 8 |
| 3 | 6 | 6.6 | 8 | 15 | 35 | 23 | 13 | 8 |
| 4 | 7 | 7 | 10 | 25 | 36 | 28 | 14 | 8 |
| 5 | 10 | 10 | 11 | 21 | 47 | 28 | 15 | 8 |
| 6 | 10 | 9 | 9 | 19 | 27 | 23 | 15 | 5 |
| 7 | 6 | 6 | 8 | 16 | 26 | 24 | 14 | 5 |
| 8 | 8 | 9 | 12 | 25 | 34 | 24 | 13 | 7 |
| 9 | 9 | 19 | 23 | 30 | 36 | 28 | 13 | 8 |

As is clear from Table III, the coercive force (Hc) increases with an elevation in the ageing temperature and reaches the desired value, i.e. 20 Oe and more, at the temperature between 700° and 800°C.

FIG. 1 illustrates data of Samples 1 through 5 and shows magnetic properties in the ordinate and content of niobium in the abscissa. In this figure, the numerical references 1 and 2 represent the specimen not subjected to drawing and the specimen aged at 700°C, respectively.

It will be apparent from FIG. 1 that the coercive force (Hc) and the saturation magnetization ($\sigma$) of the wire-rods after ageing are definitely dependent upon the content of niobium. The coercive force (Hc) increases in direct proportional relationship with an increase in the content of niobium, while the saturation magnetization ($\sigma$) decreases in direct proportional relationship with an increase in the content of niobium. It is therefore concluded that the content of niobium should be at least 3% to provide a semi-hard magnetic material having a coercive force (Hc) not lower than 20 Oe.

Figure 2:
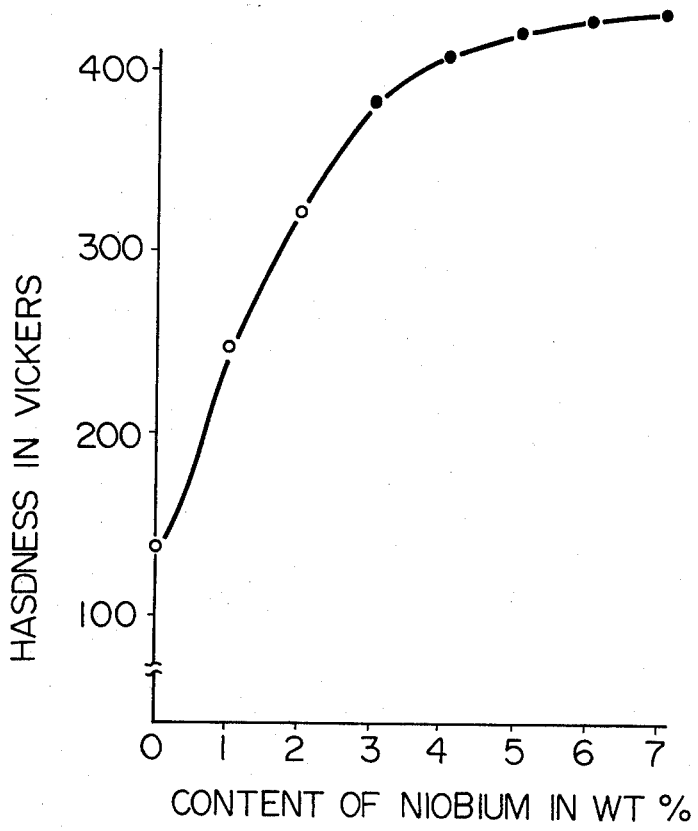
FIG. 2 is a graph illustrating the relationship of hardness to the content of niobium in various samples.

FIG. 2 illustrates dependence of the hardness in Vickers of Samples 1 through 5 and 10 through 12, aged at 700°C, upon the content of niobium. It will be apparent from this figure that the hardness increases with an increase in the content of niobium and reaches a maximum value at 7% wt content of niobium.

Figure 3:
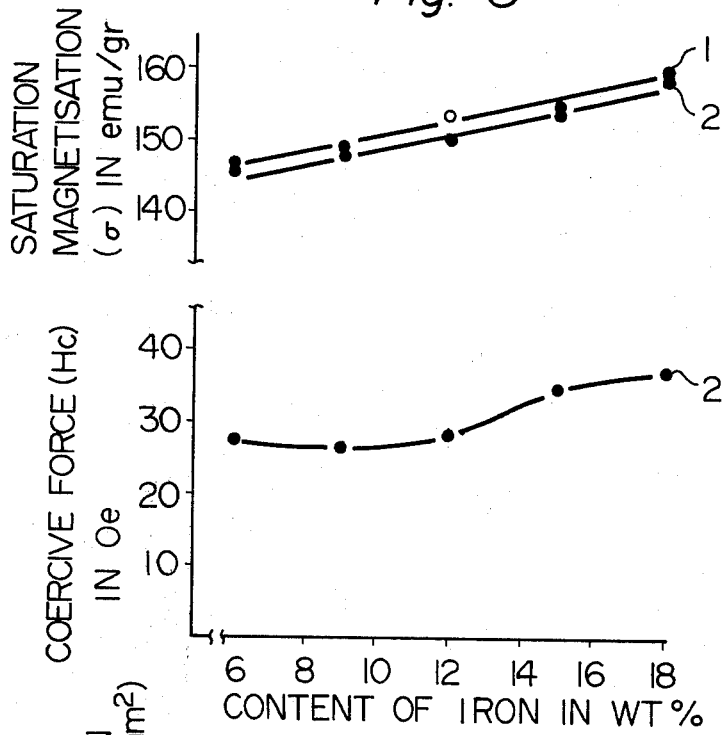
FIG. 3 is a graph illustrating the relationship of magnetic properties to the content of iron in various samples containing 4 wt% niobium.

FIG. 3 illustrates data of Samples 2, and 6 through 9, all of these containing 4% of niobium, and shows magnetic properties in the ordinate and content of iron in the abscissa. In this figure, the numerical references 1 and 2 respectively indicate specimen not subjected to ageing and specimen aged at 700°C. It will be apparent from FIG. 3 that the coercive force (Hc) slightly increases with an increase in the content of iron and, further, that the saturation magnetization ($\sigma$) increases in direct proportional relationship with an increase in the content of iron. The alloy should thus preferably be composed approximately 4% niobium, 12 to 18% of iron and 78 to 84% cobalt.

Figure 4:
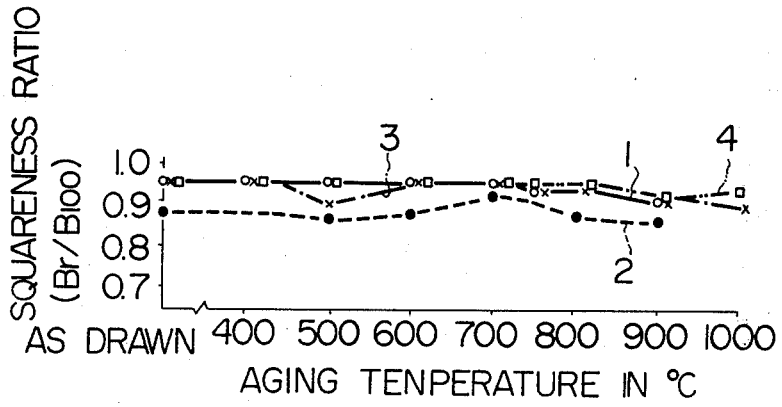
FIG. 4 is a graph illustrating the relationship between the squareness ratio ($Br/B_{100}$) and the aging temperature in °C for various samples which contain 12 wt% iron.

Samples 1 through 4 and 6 through 9, aged at a temperature between 400° and 1000°C, were then subjected to the measurement of the squareness ratio ($Br/B_{100}$). FIG. 4 shows the dependence of the squareness ratio ($Br/B_{100}$) upon the ageing temperature in °C with regard to Samples 1 through 4, all containing 12% by weight of iron. In this figure, reference numerals 1, 2, 3 and 4 represent Samples 1, 2, 3 and 4, respectively. As is clear from this figure, the wire-rods exhibit a satisfactorily high squareness ratio of higher than 0.80 at ageing temperatures between 400° and 1000°C.

Figure 5:
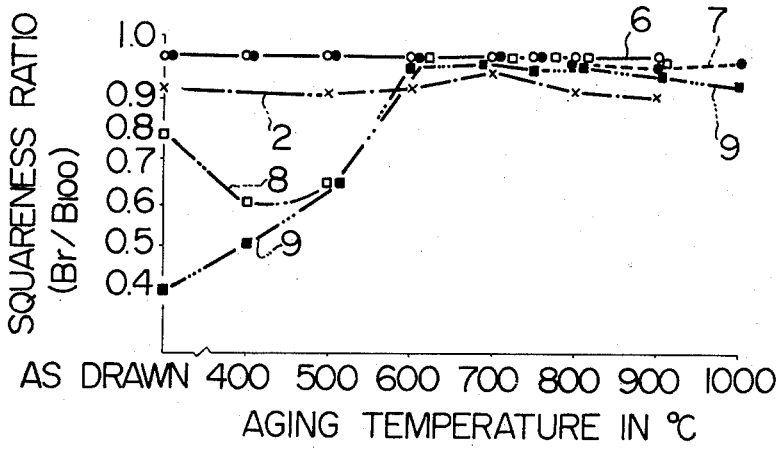
FIG. 5 is a graph illustrating the relationship between the squareness ratio ($Br/B_{100}$) and the aging temperature in °C with respect to various samples containing 4 wt% niobium.

FIG. 5 shows the same dependence with respect to Samples 2, and 6 through 9, all containing 4% by weight of niobium. In this figure, reference numerals indicate Samples of the same number. As is clear from this figure, the wire-rods of Samples 8 and 9 containing 15 and 18% of iron, respectively, exhibit a squareness ratio inferior to those of Samples 2, 6 and 7 containing 12, 6 and 9% of iron, respectively, at ageing temperatures below 600°C.

Figure 6:
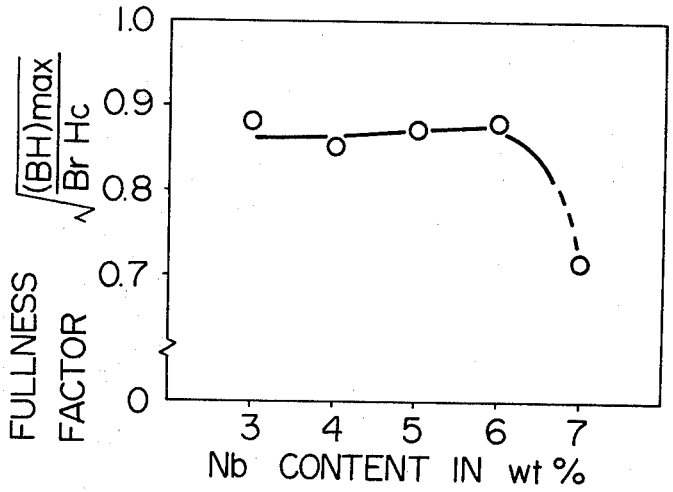
FIG. 6 is a graph illustrating the relationship of fullness factor $\sqrt{(BH)_{max}/BrHc}$ to the niobium content for various samples containing equal amounts of iron.
Figure 7:
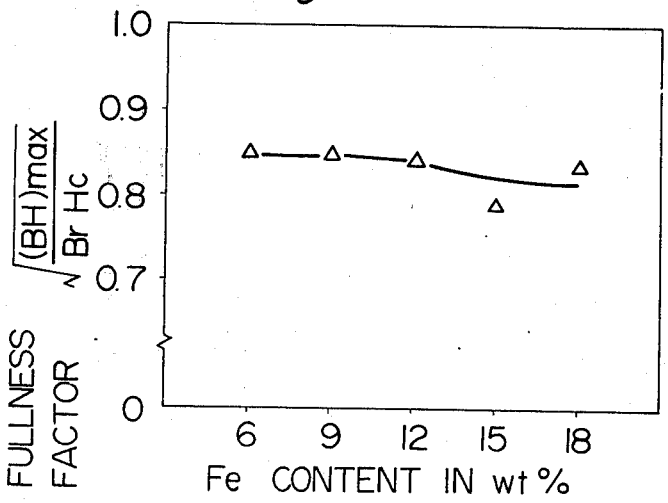
FIG. 7 is a graph illustrating the relationship of fullness factor $\sqrt{(BH)_{max}/BrHc}$ with respect to iron content for various samples containing equal amounts of niobium.

Samples 1 through 9, aged at 700°C, were further subjected to measurements of their fullness factors ($\sqrt{(BH)_{max}/BrHc}$). The results are illustrated in FIGS. 6 and 7, as the dependence of the fullness factor on the contents of iron and niobium. FIG. 6 shows the results of Samples 1 through 5, all containing equal amounts of iron but niobium in amounts of from 3, 4, 5, 6 and 7%, respectively. FIG. 7 shows the results of Samples 6, 7, 2, 8 and 9, all containing equal amounts of niobium but iron in amounts of from 6, 9, 12, 15 and 18%, respectively.

As is clear from FIGS. 6 and 7, the fullness factors of the alloys according to the present invention are not lower than 0.70 and thus are superior to that of conventional alloys ranging from approximately 0.5 to 0.7.

In addition, the fullness factor is extremely high except for Sample 5 containing the upper critical percentage of niobium.

Sample No. 5 aged at 700°C was subjected to X-ray diffractometry. Table 4 indicates a comparison of spectrograms between the sample and the standard spectrogram of $Co_3Nb$ according to A.S.T.M. card 19-355.

Table 4

| | Value of d in Angstroms (A) | | | | | | | |
|---|---|---|---|---|---|---|---|---|
| A | 2.369 | 2.181 | 2.030 | 2.020 | 1.983 | 1.945 | 1.929 | 1.905 |
| B | 2.375 | 2.177 | 2.032 | 2.022 | 1.984 | 1.945 | 1.930 | — |
| A | 1.368 | 1.329 | 1.289 | 1.234 | 1.185 | 1.159 | | |
| B | — | 1.330 | 1.291 | — | 1.187 | 1.160 | | |

Note A. indicates the standard spectrogram of $Co_3$ Nb according to A.S.T.M. card 19–355
B. indicates the measured value of Sample No. 5

The precipitated phase can be identified as $Co_3Nb$ because the measured value is in good agreement with the standard spectrogram.

Figure 8:
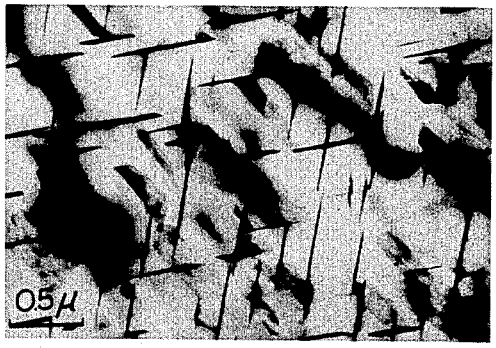
FIG. 8 illustrates $Co_3Nd$ precipitates as crystals at a magnification of 20,000.

The sample subjected to the X-ray diffractometry was further subjected to electron microscopic examination in order to observe the form of the precipitated phase. The result, at a magnification of 20,000, is shown in FIG. 8. As is clear from this figure, $Co_3Nb$ precipitates as crystals in the form of plates.

EXAMPLE 2

Samples No. 2 in Example 1 formed into wire-rods having a diameter of 2 mm were heated at 1100°C for 30 minutes for the purpose of solution treatment. The wire-rods were then cooled at a rate of 3°C/minute to six respectively different temperatures, i.e. 1000°, 900°, 800°, 700°, 600° and 500°C. The wire-rods were water-cooled from these temperatures. In addition to these treatments another treatment was carried out. Namely, immediately after a wire-rod of Sample No. 2 was heated at 1100°C for 30 minutes, it was water-cooled. The wire-rods quenched by all of the methods described above were subjected to measurements of tensile strength.

Figure 9:
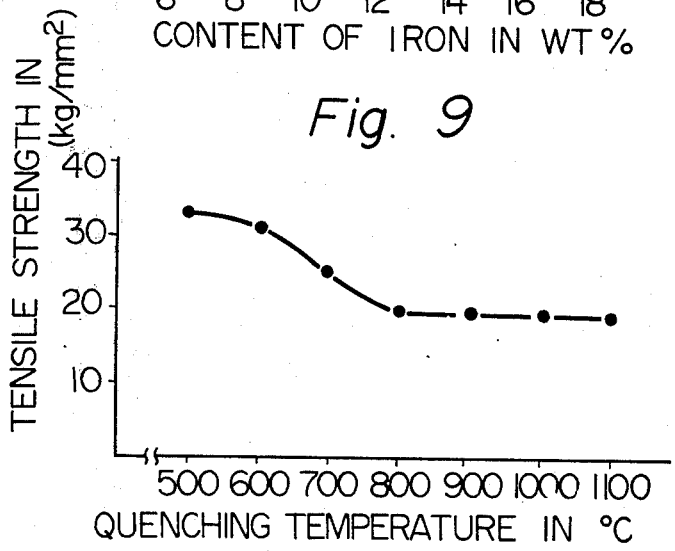
FIG. 9 is a graph illustrating the relationship of tensile strength with respect to quenching temperature for various samples.

FIG. 9 illustrates dependence of tensile strength in $kg/mm^2$ upon the temperature in °C at which the quenching is started, hereinafter referred to as the quenching temperature. It will be apparent from this figure that the tensile strength is maintained at a constant low value if the quenching temperature is not lower than 800°C. Contrary to this, if the quenching temperature is below 800°C the tensile strength is increased with the decrease in the quenching temperature, due to the fact that the alloy containing not less than 3% of niobium tends to harden during cooling in the range of 500° to 800°C. Quenching in the range of 500° to 800°C thus enables suppression of the hardening, thereby ensuring excellent cold workability.

EXAMPLE 3

Figure 10:
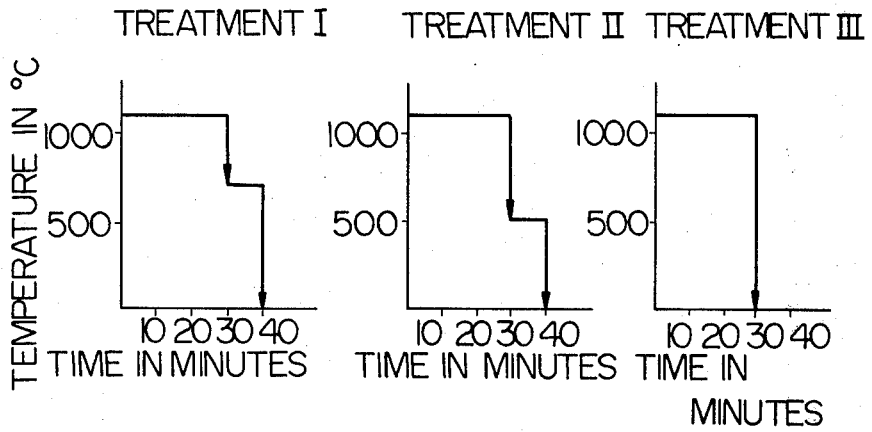
FIG. 10 is a time-temperature diagram for three kinds of solution treatments I, II and III.

Sample No. 2 in Example 1 formed into wire-rods of 2 mm diameter, were solution-treated in the three different ways shown in FIG. 10. FIG. 10 illustrates the time-temperature diagram for the three kinds of solution treatments I, II and III. In all of the treatments the wire-rods were heated at 1100°C for 30 minutes. The wire-rods were then cooled to a room temperature in three different ways: in Treatment I the wire-rod was quenched to 700°C and maintained at this temperature for 10 minutes and, finally, quenched to room temperature by immersing the wire-rod in water; in Treatment II the wire-rod was quenched to 500°C and maintained at this temperature for 10 minutes and, finally, quenched to room temperature by immersing the wire-rod in water, and; in Treatment III the wire-rod was quenched without interruption to room temperature by immersing the wire-rod in water. The wire-rods solution treated according to the three kinds of treatment were subjected to measurement of hardness in Vickers. The wire-rods treated according to Treatments I, II and III had hardness of Hv 300–400, Hv 170–260 and Hv 150–190, respectively, Treatment I and III, therefore, provided the hardest and softest wire-rods, respectively, and Treatment II provided medium hardness.

The wire-rods having a diameter of 2.0 mm and solution-treated in the above described different ways were cold drawn in eight stages into wire-rods having diameter of 0.7 mm in a manner such that the diameter of the dies were decreased in turn to a value of 1.8, 1.6, 1.4, 1.2, 1.0, 0.90, 0.80 and 0.70 mm. The drawing rate was 500 mm/minute except that the drawing rate of the wire-rod solution treated according to Treatment III were 300/minute as well as 500 mm/minute.

Figure 11:
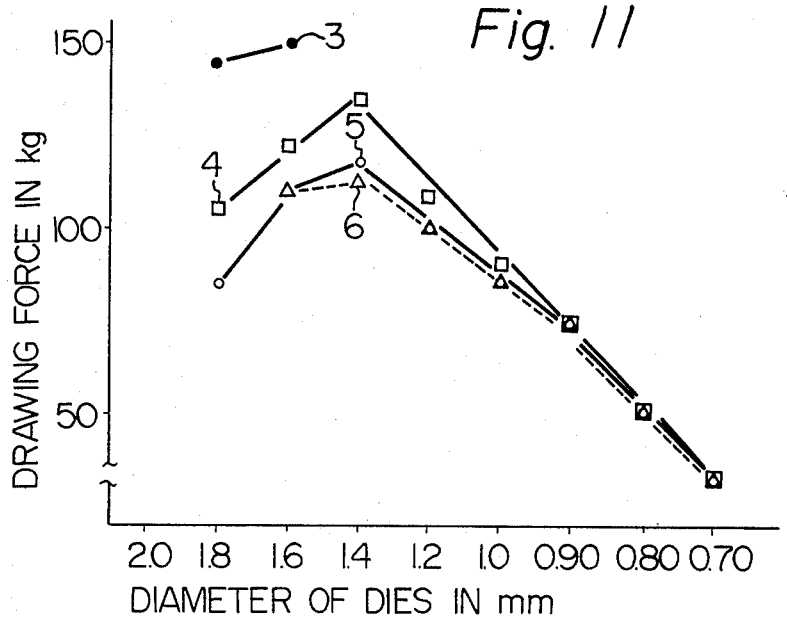
FIG. 11 is a graph illustrating the relationship of drawing force required with respect to the diameter of dyes for various rod wires drawn at specified rates.

FIG. 11 illustrates the dependence of the force required for drawing in kg, shown in the ordinate, upon the diameters of the dies in mm, shown in the abscissa In this figure, the numerical references 3, 4, and 5 indicate the wire-rods drawn at a rate of 500 mm/minute and solution treated according to Treatments I, II and III, respectively, and the numerical reference 6 indicate the wire-rod drawn at a rate of 300 mm/minute and the solution treated according to Treatment III. In this figure the data with numerical reference 3 are not plotted with regard to diameters below 1.6 mm, because the wire-rod solution treated according to Treatment I ruptured during drawing from 1.6 to 1.4 mm due to the fact that a drawing force exceeding the fracture strength was applied to the wire-rod.

The following facts will be apparent from FIG. 11. The wire-rod solution treated according to Treatment I requires high drawing force in cold drawing. Treatments II and III ensure the cold working at a lower drawing force, than Treatment I. Treatment III (i.e., quenching from the solution temperature to room temperature without interruption) provides the most advantageous way of carrying out the desired cold working.

EXAMPLE 4

Figure 12:
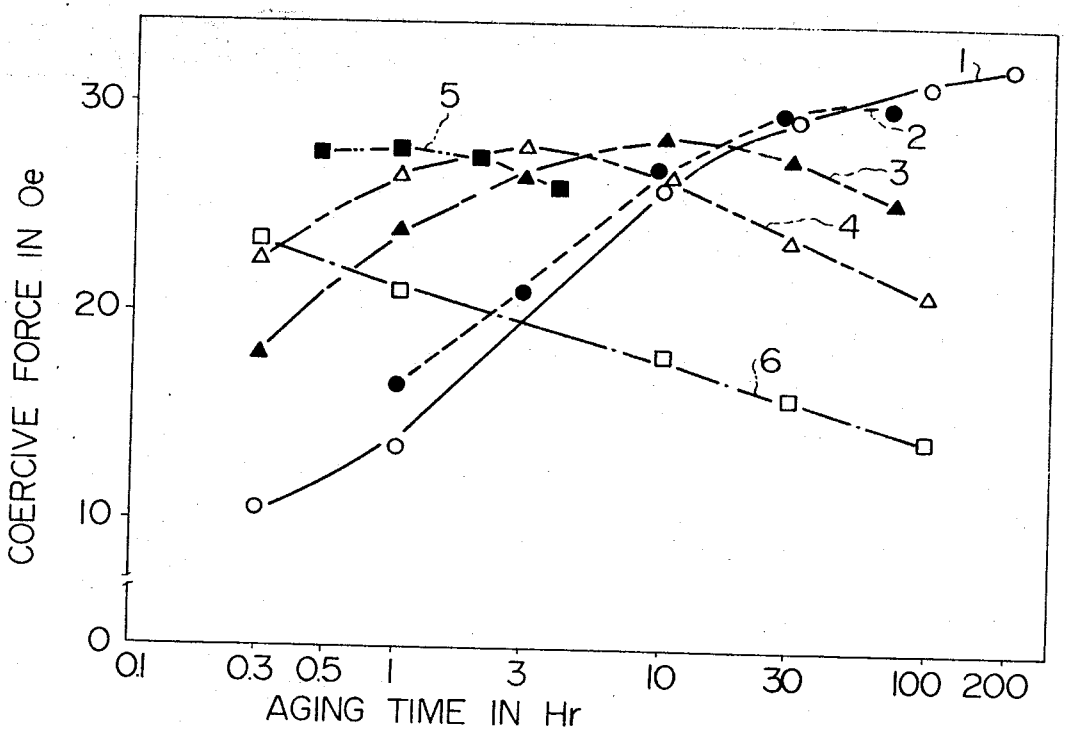
FIG. 12 is a graph illustrating the relationship of the coercive force in Oe to the aging time in hours for samples aged at various temperatures.

Samples No. 2 in Example 1, formed into wire-rods having diameters of 0.6 mm, were aged at a temperature between 600° and 800°C over a time period within a range of from 0.3 to 200 hours. The wire-rods so treated were then subjected to measurement of the coercive force (Hc). FIG. 12 shows the dependence of the coercive force in Oe upon the ageing time in hours. In this figure, reference numerals 1, 2, 3, 4, 5 and 6 represent ageing temperatures 600°, 630°, 670°, 700°, 730° and 800°C, respectively. It will be apparent from this figure that the desired coercive force (Hc) of not less than 20 Oe can be obtained by adjusting the ageing time depending upon ageing temperature.

What we claim is:

1. A process for producing a semi-hard magnetic material having a coercive force of from 20 to 50 Oe, said process comprising the steps of:

working an ingot of alloy consisting essentially, by weight, of 73 to 93% of cobalt, 3 to 7% of niobium, and 6 to 18% iron, into an article having a suitable form;

subjecting the article to solution treatment by heating the article to a solution temperature not lower than 1000°C; cooling said article from said solution temperature to room temperature wherein said step of cooling includes quenching said article from at least 800° to 500°C;

subjecting the quenched article to cold working at a reduction of area not less than 75%; and ageing the cold worked article at a temperature from 500° to 900°C selected to yield a squareness ratio above 0.8 and a fullness factor over 0.7.

2. A process according to claim 1, wherein the alloy consist essentially, by weight, of 78 to 90% of cobalt, 3 to 7% of niobium and 6 to 18% of iron.

3. A process according to claim 1, wherein the alloy consist essentially, by weight, of 80 to 87% of cobalt, 4 to 5% of niobium and 9 to 15% of iron.

4. A process according to claim 1, wherein said solution temperature is 1100°C.

5. A process according to claim 2, wherein said solution temperature is 1100°C.

6. A process for producing a semi-hard magnetic material having a coercive force of from 20 to 50 Oe, said process comprising the steps of:

working an ingot of alloy consisting essentially by weight, of 73 to 93% of cobalt, 3 to 7% of niobium, and 6 to 18% iron, into an article having a suitable form;

heating the article to a solution temperature not lower than 1000°C;

cooling said article from said solution temperature to a first temperature of not lower than 800°C;

quenching said article from said first temperature to a second temperature of 500°C at the highest, said second temperature being substantially higher than room temperature;

cooling said article to room temperature;

subjecting said room temperature cooled article to cold working at a reduction of area not less than 75%; and ageing the cold worked article at a temperature from 500° to 900°C selected to yield a squareness ratio above 0.8 and a fullness factor over 0.7.

7. A process according to claim 6, wherein the alloy consists essentially, by weight, of 78 to 90% of cobalt, 3 to 7% of niobium and 6 to 18% of iron.

8. A process according to claim 6, wherein the alloy consists essentially, by weight of 80 to 87% of cobalt, 4 to 5% of niobium and 9 to 15% of iron.

9. A process for producing a semi-hard magnetic material having a coercive force of from 20 to 50 Oe, said process comprising the steps of:

working an ingot of alloy consisting essentially by weight, of 73 to 93% of cobalt, 3 to 7% of niobium, and 6 to 18% iron, into an article having a suitable form;

heating the article to a solution temperature not lower than 1000°C;

quenching said article from said solution temperature to a first temperature in the range of 300° to 500°C;

maintaining said article at said first temperature for a predetermined time;

cooling said article from said first temperature to room temperature;

subjecting the cooled article to cold working at a reduction of area not less than 75%; and ageing the cold worked article at a temperature from 500° to 900°C selected to yield a squareness ratio above 0.8 and and a fullness factor over 0.7.

10. A process according to claim 9, wherein said solution temperature is 1100°C and said first temperature is 500°C.

11. A process according to claim 9, wherein said alloy consists essentially of, by weight, of 78 to 90% of cobalt, 3 to 7% of niobium and 6 to 18% of iron.

12. A process according to claim 11, wherein said solution temperature is 1100°C and said first temperature is 500°C.

13. A process according to claim 1, wherein said article is quenched from the solution temperature to room temperature.

14. A process according to claim 2, wherein said article is quenched from the solution temperature to room temperature.

* * * * *

UNITED STATES PATENT AND TRADEMARK OFFICE

CERTIFICATE OF CORRECTION

PATENT NO. : 3,983,916

DATED : October 5, 1976

INVENTOR(S) : Zenzo Henmi et al

It is certified that error appears in the above-identified patent and that said Letters Patent are hereby corrected as shown below:

At "[54]" change title to read --PROCESS FOR PRODUCING SEMI-HARD Co-Nb-Fe MAGNETIC MATERIALS--.

Column 1, line 30, correct where the print has faded.

Column 7, line 8, after "composed" insert --of--.

Column 9, line 12, insert a period after "abscissa".

Signed and Sealed this

Fifteenth Day of February 1977

[SEAL]

*Attest:*

RUTH C. MASON
*Attesting Officer*

C. MARSHALL DANN
*Commissioner of Patents and Trademarks*